US011378094B2

(12) United States Patent
Fujiwara et al.

(10) Patent No.: US 11,378,094 B2
(45) Date of Patent: Jul. 5, 2022

(54) CENTRIFUGAL COMPRESSOR

(71) Applicant: IHI Corporation, Koto-ku (JP)

(72) Inventors: Takashi Fujiwara, Tokyo (JP); Ryusuke Numakura, Tokyo (JP); Kengo Matsuo, Tokyo (JP); Kensuke Hirata, Tokyo (JP); Yuji Sasaki, Tokyo (JP)

(73) Assignee: IHI Corporation, Koto-ku (JP)

( * ) Notice: Subject to any disclaimer, the term of this patent is extended or adjusted under 35 U.S.C. 154(b) by 214 days.

(21) Appl. No.: 16/704,004

(22) Filed: Dec. 5, 2019

(65) Prior Publication Data

US 2020/0109719 A1 Apr. 9, 2020

Related U.S. Application Data

(63) Continuation of application No. PCT/JP2018/024688, filed on Jun. 28, 2018.

(30) Foreign Application Priority Data

Jun. 28, 2017 (JP) ..... JP2017-126760

(51) Int. Cl.
*F04D 29/42* (2006.01)
*F04D 29/22* (2006.01)
(Continued)

(52) U.S. Cl.
CPC ..... *F04D 29/42* (2013.01); *F04D 29/22* (2013.01); *F04D 29/4206* (2013.01);
(Continued)

(58) Field of Classification Search
CPC .. F04D 29/4206; F04D 29/22; F04D 29/4213; F04D 29/441; F04D 29/462; F04D 29/681; F04D 29/42; F05D 2220/40
See application file for complete search history.

(56) References Cited

U.S. PATENT DOCUMENTS 4,643,639 A 2/1987 Caine
2001/0028839 A1 10/2001 Nakao
(Continued)

FOREIGN PATENT DOCUMENTS

CN 1542290 A 11/2004
CN 101520054 A 9/2009
(Continued)

OTHER PUBLICATIONS

International Search Report dated Sep. 18, 2018 in PCT/JP2018/024688 filed on Jun. 28, 2018, 1 page.
(Continued)

*Primary Examiner* — Courtney D Heinle
*Assistant Examiner* — Andrew J Marien
(74) *Attorney, Agent, or Firm* — Oblon, McClelland, Maier & Neustadt, L.L.P.

(57) ABSTRACT

A centrifugal compressor includes: an impeller; a main flow passage which receives the impeller and extends in a rotation axis direction of the impeller; an auxiliary flow passage which includes an upstream communication portion communicating to the main flow passage and a downstream communication portion communicating to the main flow passage at closer to the impeller than the upstream communication portion, and extends in a rotation direction of the impeller; a plurality of opening/closing portions which each have an opening portion and are arranged in the auxiliary flow passage; and a drive unit configured to move at least one of the plurality of opening/closing portions in the rotation direction.

12 Claims, 13 Drawing Sheets

(51) Int. Cl.
*F04D 29/68* (2006.01)
*F04D 29/46* (2006.01)
*F04D 29/44* (2006.01)

(52) U.S. Cl.
CPC ..... *F04D 29/4213* (2013.01); *F04D 29/441* (2013.01); *F04D 29/462* (2013.01); *F04D 29/681* (2013.01); *F05D 2220/40* (2013.01)

(56) References Cited

U.S. PATENT DOCUMENTS

| | | | | |
|---|---|---|---|---|
| 2011/0002770 | A1* | 1/2011 | Bywater | F04D 29/4213 415/1 |
| 2014/0308110 | A1 | 10/2014 | Houst et al. | |
| 2015/0037141 | A1* | 2/2015 | Gerard | F04D 29/4213 415/119 |
| 2016/0090901 | A1* | 3/2016 | Svihla | F04D 29/685 60/605.1 |
| 2016/0123333 | A1 | 5/2016 | Mohtar et al. | |
| 2016/0201693 | A1* | 7/2016 | An | F04D 29/4213 415/58.4 |

FOREIGN PATENT DOCUMENTS

| | | | |
|---|---|---|---|
| CN | 103161766 | A | 6/2013 |
| CN | 105026769 | A | 11/2015 |
| DE | 10 2008 046 220 | A1 | 3/2010 |
| JP | 2003-106293 | A | 4/2003 |
| JP | 2006-002650 | A | 1/2006 |
| JP | 2012-036782 | A | 2/2012 |
| JP | 2012-177311 | A | 9/2012 |
| JP | 2013-133748 | A | 7/2013 |
| JP | 5824821 | B2 | 12/2015 |

OTHER PUBLICATIONS

Combined Chinese Office Action and Search Report dated Aug. 24, 2020 in Chinese Patent Application No. 201880040607.9, 6 pages.
Combined Chinese Office Action and Search Report dated Dec. 3, 2021 in Chinese Patent Application No. 201880040607.9 (with English translation of Categories of Cited Documents), 5 pages.

* cited by examiner

CENTRIFUGAL COMPRESSOR

CROSS REFERENCE TO RELATED APPLICATIONS

This application is a continuation application of International Application No. PCT/JP2018/024688, filed on Jun. 28, 2018, which claims priority based on Japanese Patent Application No. 2017-126760, filed on Jun. 28, 2017, the entire contents of which are incorporated by reference herein.

BACKGROUND ART

Technical Field

The present disclosure relates to a centrifugal compressor in which an auxiliary flow passage communicating to a main flow passage is formed.

Related Art

In some cases, a centrifugal compressor has an auxiliary flow passage communicating to a main flow passage. A compressor impeller is arranged in the main flow passage. On an upstream side of the compressor impeller in the main flow passage, a flow passage width is reduced by a narrowing portion. The main flow passage and the auxiliary flow passage communicate to each other through an upstream communication portion and a downstream communication portion. An on-off valve is arranged in the auxiliary flow passage. In a range of a small flow rate, the on-off valve is closed. When the flow rate becomes larger, the on-off valve is opened and a flow-passage sectional area is increased.

In the centrifugal compressor described in Patent Literature 1, a spherical flow passage is formed in an auxiliary flow passage. An inner peripheral surface and an outer peripheral surface of the spherical flow passage are concentric spherical surfaces. A plurality of valve bodies of on-off valves are arrayed in a rotation direction of a compressor impeller. The valve bodies each have an arc shape conforming to the inner peripheral surface and the outer peripheral surface of the spherical flow passage. The valve bodies are supported so as to be rotatable by rotation shafts. A plurality of rotation shafts are provided in a radial pattern. Axial centers of the rotation shafts pass through curvature centers of the inner peripheral surface and the outer peripheral surface of the spherical flow passage. Through rotation of the rotation shafts, the plurality of valve bodies are arrayed substantially in flush with one another, thereby closing the valve.

CITATION LIST

Patent Literature

Patent Literature 1: Japanese Patent No. 5824821

SUMMARY

Technical Problem

However, as described in Patent Literature 1, an opening/closing mechanism configured to open and close the auxiliary flow passage is complicated. Therefore, there has been a demand for development of a technology for simplifying the structure thereof.

The present disclosure has an object to provide a centrifugal compressor capable of simplifying structure.

Solution to Problem

In order to solve the above-mentioned problem, according to one embodiment of the present disclosure, there is provided a centrifugal compressor, including: an impeller; a main flow passage which receives the impeller and extends in a rotation axis direction of the impeller; an auxiliary flow passage which includes an upstream communication portion communicating to the main flow passage and a downstream communication portion communicating to the main flow passage at closer to the impeller than the upstream communication portion, and extends in a rotation direction of the impeller; a plurality of opening/closing portions which each have an opening portion and are arranged in the auxiliary flow passage; and a drive unit configured to move at least one of the plurality of opening/closing portions in the rotation direction.

The centrifugal compressor may further include a narrowing portion projecting toward an inner side in a radial direction of the impeller with respect to the upstream communication portion and the downstream communication portion.

The centrifugal compressor may further include an impeller-side flow passage portion which is provided in the auxiliary flow passage, includes the downstream communication portion, and extends toward an inner side in a radial direction of the impeller as approaching the impeller, wherein the plurality of opening/closing portions are arranged closer to the upstream communication portion than the impeller-side flow passage portion.

The plurality of opening/closing portions may include a first opening/closing portion and a second opening/closing portion located closer to the downstream communication portion than the first opening/closing portion, and the first opening/closing portion may include a pair of first guide portions whose separation distance decreases as approaching the downstream communication portion away from the upstream communication portion.

The plurality of opening/closing portions may include a first opening/closing portion and a second opening/closing portion located closer to the downstream communication portion than the first opening/closing portion, and the second opening/closing portion may include a pair of second guide portions whose separation distance increases as approaching the downstream communication portion away from the upstream communication portion.

A plan-view shape of the opening portion at least may have a length in the rotation direction on a radially inner side shorter than that on a radially outer side or may have both end portions in the rotation direction in a curved shape.

Effects of Disclosure

According to the present disclosure, the centrifugal compressor is capable of simplifying structure.

DESCRIPTION OF EMBODIMENT

Figure 1:
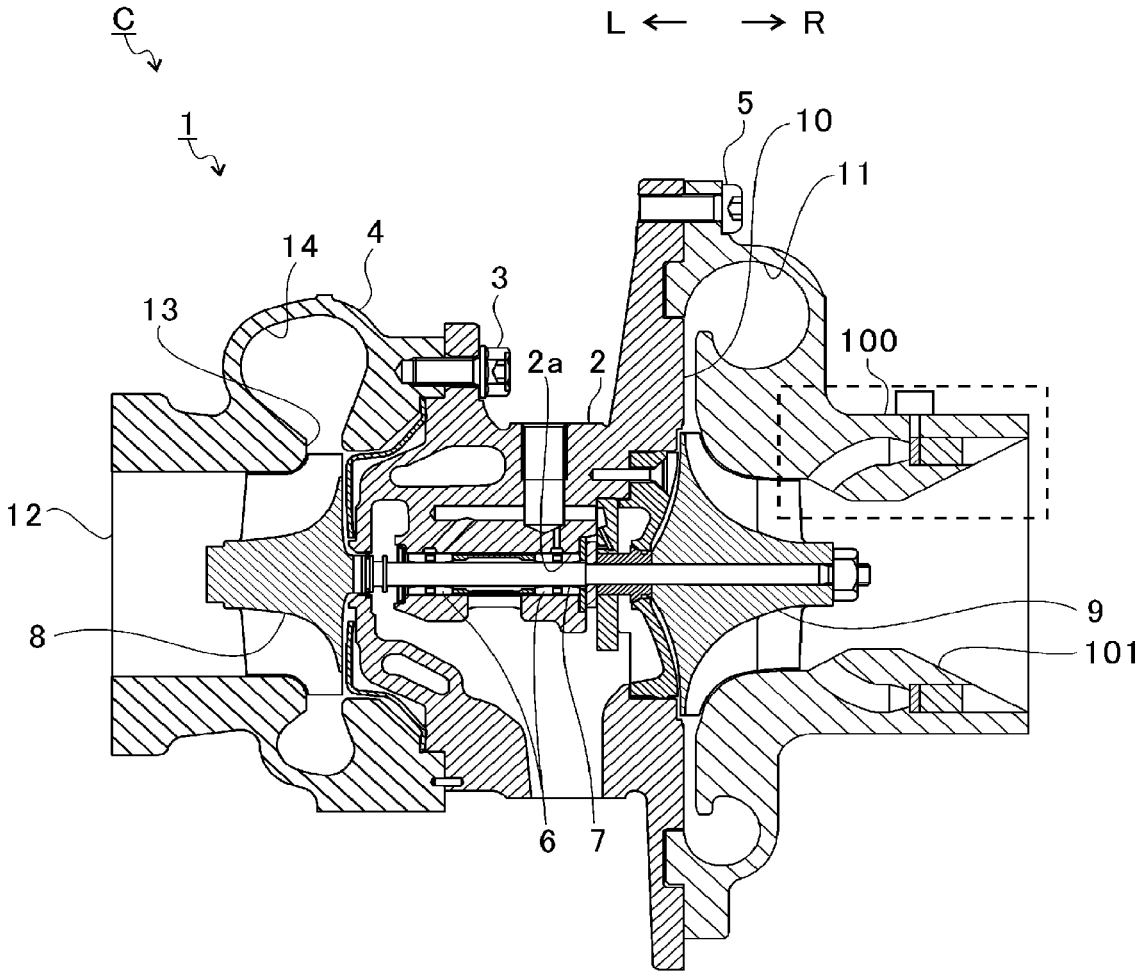
FIG. 1 is a schematic sectional view of a turbocharger.

Now, with reference to the attached drawings, one embodiment of the present disclosure is described in detail. The dimensions, materials, and other specific numerical values represented in the embodiment are merely examples used for facilitating the understanding of the present disclosure, and do not limit the present disclosure otherwise particularly noted. Elements having substantially the same functions and configurations herein and in the drawings are denoted by the same reference symbols to omit redundant description thereof. Further, illustration of elements with no direct relationship to the present disclosure is omitted.

FIG. 1 is a schematic sectional view of a turbocharger C. In the following description, the direction indicated by the arrow L illustrated in FIG. 1 corresponds to a left side of the turbocharger C, and the direction indicated by the arrow R illustrated in FIG. 1 corresponds to a right side of the turbocharger C. A part of the turbocharger C on a compressor impeller 9 (impeller) side, described later, functions as a centrifugal compressor. In the following, description is made of the turbocharger C as one example of applications of the centrifugal compressor. However, the application of the centrifugal compressor is not limited to the turbocharger C. The centrifugal compressor may be incorporated into a device other than the turbocharger C, or may be solely provided.

As illustrated in FIG. 1, the turbocharger C includes a turbocharger main body 1. The turbocharger main body 1 includes a bearing housing 2. A turbine housing 4 is coupled to the left side of the bearing housing 2 with a fastening bolt 3. A compressor housing 100 is coupled to the right side of the bearing housing 2 with a fastening bolt 5.

The bearing housing 2 has a bearing hole 2*a*. The bearing hole 2*a* passes through the turbocharger C in a right-and-left direction. Bearings 6 are provided in the bearing hole 2*a*. In FIG. 1, full-floating bearings are illustrated as one example of the bearings 6. However, the bearings 6 may be other radial bearings such as semi-floating bearings or rolling bearings. The bearings 6 are configured to support the shaft 7 so that the shaft 7 is freely rotatable. A turbine impeller 8 is provided at a left end portion of the shaft 7. The turbine impeller 8 is accommodated in the turbine housing 4 so as to be freely rotatable. A compressor impeller 9 is provided at a right end portion of the shaft 7. The compressor impeller 9 is accommodated in the compressor housing 100 so as to be freely rotatable.

The compressor housing 100 has a main flow passage 101. The main flow passage 101 is opened on the right side of the turbocharger C. The main flow passage 101 extends in a rotation axis direction of the compressor impeller 9 (hereinafter simply referred to as "rotation axis direction"). The main flow passage 101 is connected to an air cleaner (not shown). The compressor impeller 9 is arranged in the main flow passage 101.

As described above, under a state in which the bearing housing 2 and the compressor housing 100 are coupled to each other with the fastening bolt 5, a diffuser flow passage 10 is formed. The diffuser flow passage 10 is formed by opposed surfaces of the bearing housing 2 and the compressor housing 100. The diffuser flow passage 10 increases air in pressure. The diffuser flow passage 10 is annularly formed so as to extend from an inner side toward an outer side in a radial direction of the shaft 7. The diffuser flow passage 10 communicates to the main flow passage 101 on the radially inner side.

Further, a compressor scroll flow passage 11 is provided to the compressor housing 100. The compressor scroll flow passage 11 has an annular shape. The compressor scroll flow passage 11 is positioned, for example, on the radially outer side of the shaft 7 with respect to the diffuser flow passage 10. The compressor scroll flow passage 11 communicates to a suction port of an engine (not shown). The compressor scroll flow passage 11 communicates also with the diffuser flow passage 10. Rotation of the compressor impeller 9 causes air to be taken into the compressor housing 100 from the main flow passage 101. The air having been taken is accelerated by an action of a centrifugal force in a course of flowing through between blades of the compressor impeller 9. The air having been accelerated is increased in pressure in the diffuser flow passage 10 and the compressor scroll flow passage 11. The air having been increased in pressure is introduced to the suction port of an engine.

The turbine housing 4 has a discharge port 12. The discharge port 12 is opened on the left side of the turbocharger C. The discharge port 12 is connected to an exhaust gas purification device (not shown). Moreover, a flow passage 13 and a turbine scroll flow passage 14 are provided in the turbine housing 4. The turbine scroll flow passage 14 has an annular shape. The turbine scroll flow passage 14 is located, for example, on an outer side with respect to the flow passage 13 in a radial direction of the turbine impeller 8. The turbine scroll flow passage 14 communicates to a gas inflow port (not shown). Exhaust gas to be discharged from a discharge manifold (not shown) of the engine is introduced to the gas inflow port. The gas inflow port communicates also to the flow passage 13. The exhaust gas having been introduced from the gas inflow port to the turbine scroll flow passage 14 is introduced to the discharge port 12 through the flow passage 13 and between blades of the turbine impeller 8. The exhaust gas having been introduced to the discharge port 12 causes the turbine impeller 8 to rotate in a course of flow.

In addition, the rotation force of the turbine impeller 8 is transmitted to the compressor impeller 9 via the shaft 7. As described above, the air is increased in pressure by the rotation force of the compressor impeller 9 and is introduced to the suction port of the engine.

Figure 2:
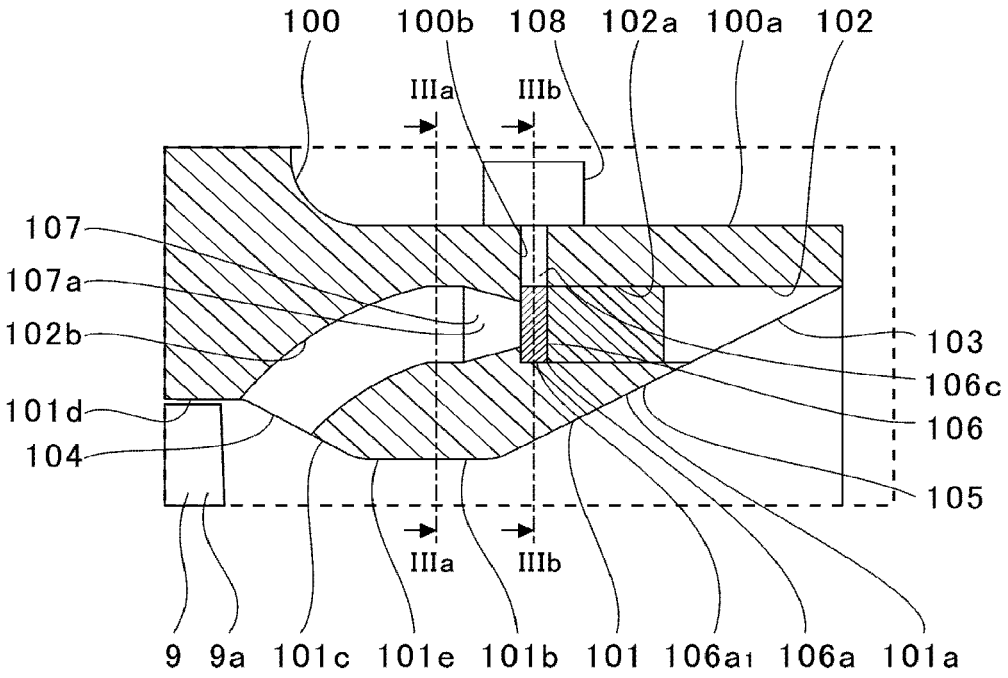
FIG. 2 is an extraction view of the broken-line portion of FIG. 1.

FIG. 2 is an extraction view of the broken-line portion of FIG. 1. As illustrated in FIG. 2, the compressor housing 100 has the main flow passage 101 and an auxiliary flow passage 102. The main flow passage 101 includes a radially contracted portion 101*a*, an upstream parallel portion 101*b*, a radially expanded portion 101*c*, and a downstream parallel portion 101*d*. The radially contracted portion 101*a* is reduced in inner diameter toward the compressor impeller 9 side. The radially contracted portion 101*a* is opened at an end surface of a cylindrical portion 100*a* of the compressor housing 100. The upstream parallel portion 101*b* is parallel to the rotation axis direction. The upstream parallel portion 101*b* is continuous from the radially contracted portion 101*a* toward the compressor impeller 9 side. The radially expanded portion 101*c* is increased in inner diameter toward the compressor impeller 9 side. The radially expanded portion 101*c* is continuous from the upstream parallel portion 101*b* toward the compressor impeller 9 side. The downstream parallel portion 101*d* is parallel to the rotation axis direction. The downstream parallel portion 101*d* is continuous from the radially expanded portion 101*c* toward the compressor impeller 9 side. The radially contracted portion 101*a*, the upstream parallel portion 101*b*, and the radially expanded portion 101*c* are located on an upstream side with respect to blades 9*a* of the compressor impeller 9. The blades 9*a* of the compressor impeller 9 are arranged on an inner peripheral side of the downstream parallel portion 101*d*.

The main flow passage 101 has a narrowing portion 101*e* formed of the radially contracted portion 101*a*, the upstream parallel portion 101*b*, and the radially expanded portion 101*c*. The narrowing portion 101*e* projects toward an inner side in the radial direction of the compressor impeller 9 with respect to the inner peripheral surface of the downstream parallel portion 101*d*. The narrowing portion 101*e* projects, for example, toward the inner side in the radial direction of the compressor impeller 9 with respect to an upstream communication portion 103 and a downstream communication portion 104, which are described later. The narrowing portion 101*e* is located, for example, between the upstream communication portion 103 and the downstream communication portion 104 in the rotation axis direction. The narrowing portion 101*e* is opposed to the compressor impeller 9 in the rotation axis direction. A part of the main flow passage 101 having the narrowing portion 101*e* is reduced in flow passage sectional area by the narrowing portion 101*e*. The main flow passage 101 may have at least the narrowing portion 101*e*. For example, the radially contracted portion 101*a* and the radially expanded portion 101*c* may be continuous with each other without the upstream parallel portion 101*b*, and the narrowing portion 101*e* may be formed at a connection portion therebetween.

The auxiliary flow passage 102 is formed in the cylindrical portion 100*a* of the compressor housing 100. The auxiliary flow passage 102 is formed on a radially outer side of the main flow passage 101. The auxiliary flow passage 102 extends in a rotation direction of the compressor impeller 9 (hereinafter simply referred to as "rotation direction" and corresponding to a circumferential direction of the shaft 7 and a circumferential direction of a separation wall portion 105 described later). The auxiliary flow passage 102 includes a parallel portion 102*a* and an impeller-side flow passage portion 102*b*. An inner wall surface of the parallel portion 102*a* extends in the rotation axis direction.

The impeller-side flow passage portion 102*b* extends, for example, toward the radially inner side as approaching the compressor impeller 9. A sectional shape of the impeller-side flow passage portion 102*b* parallel to the rotation axis of the compressor impeller 9 (hereinafter simply referred to as "rotation axis") is curved. A curvature center of the impeller-side flow passage portion 102*b* is located on the radially inner side (lower right side in FIG. 2) with respect to the impeller-side flow passage portion 102*b*. However, the curvature center of the impeller-side flow passage portion 102*b* may be located on the radially outer side (upper left side in FIG. 2) with respect to the impeller-side flow passage portion 102*b*. Moreover, a sectional shape of the impeller-side flow passage portion 102*b* parallel to the rotation axis may be a straight-line shape.

The auxiliary flow passage 102 communicates to the main flow passage 101 through the upstream communication portion 103 and the downstream communication portion 104. The upstream communication portion 103 and the downstream communication portion 104 are opening portions which are open to the main flow passage 101. The upstream communication portion 103 is opened to the radially contracted portion 101*a*. The downstream communication portion 104 is opened to the radially expanded portion 101*c*. The downstream communication portion 104 is opened on the upstream side with respect to the compressor impeller 9 in the main flow passage 101. The downstream communication portion 104 is located on the compressor impeller 9 side with respect to the upstream communication portion 103. The upstream communication portion 103 is provided at the parallel portion 102*a*. The downstream communication portion 104 is provided at the impeller-side flow passage portion 102*b*.

The separation wall portion 105 is provided to the compressor housing 100. The separation wall portion 105 is provided inside the cylindrical portion 100*a*. The separation wall portion 105 is located between the auxiliary flow passage 102 and the main flow passage 101 in the radial direction. The separation wall portion 105 partitions the main flow passage 101 and the auxiliary flow passage 102. The separation wall portion 105 has, for example, an annular shape. However, the shape of the separation wall portion 105 is not limited to the annular shape, and a part of the separation wall portion 105 in the circumferential direction may be cut out. An inner periphery of the separation wall portion 105 faces the radially contracted portion 101*a*, the upstream parallel portion 101*b*, and the radially expanded portion 101*c* of the main flow passage 101. An outer periphery of the separation wall portion 105 faces the parallel portion 102*a* and the impeller-side flow passage portion 102*b* of the auxiliary flow passage 102. In other words, an inner peripheral surface of the separation wall portion 105 forms a part of the main flow passage 101. An outer peripheral surface of the separation wall portion 105 forms a part of the auxiliary flow passage 102.

Figure 3A:
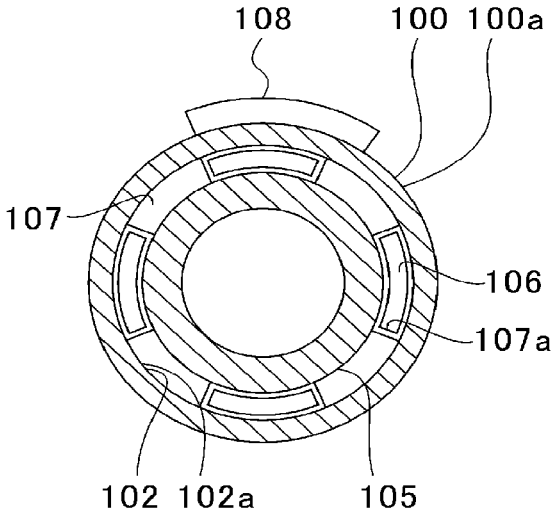
FIG. 3A is a sectional view taken along the line IIIa-IIIa of FIG. 2.
Figure 3B:
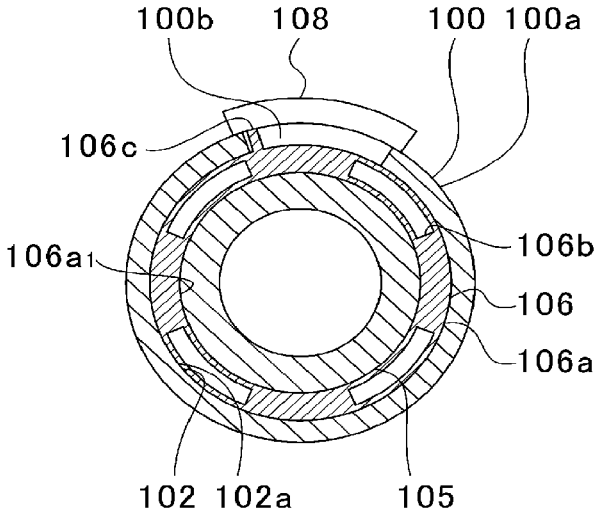
FIG. 3B is a sectional view taken along the line IIIb-IIIb of FIG. 2.
Figure 3C:
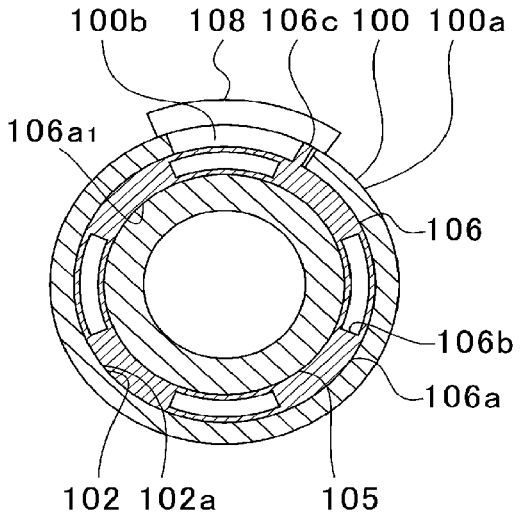
FIG. 3C is a view for illustrating a state in which, in the cross section of FIG. 3B, a first opening/closing portion takes a position different from that of FIG. 3B.

FIG. 3A is a sectional view taken along the line IIIa-IIIa of FIG. 2. FIG. 3B is a sectional view taken along the line IIIb-IIIb of FIG. 2. FIG. 3C is a view for illustrating a state in which, in the cross section of FIG. 3B, a first opening/closing portion 106 takes a position different from that of FIG. 3B. As illustrated in FIG. 2, FIG. 3A, FIG. 3B, and FIG. 3C, a first opening/closing portion 106 and a second opening/closing portion 107 are provided at the parallel portion 102*a* of the auxiliary flow passage 102. The first opening/closing portion 106 and the second opening/closing portion 107 are located at the parallel portion 102*a* on an impeller-side flow passage portion 102*b* side (compressor impeller 9 side) with respect to the center of the parallel portion 102*a* in the rotation axis direction. However, one or both of the first opening/closing portion 106 and the second opening/closing portion 107 may be provided at the impeller-side flow passage portion 102*b*.

The first opening/closing portion 106 includes a main body portion 106*a* formed of an annular plate member. The first opening/closing portion 106 is not limited to the annular shape, and, for example, a part thereof in the circumferential direction may be cut out. The first opening/closing portion 106 is not limited to the plate member, and may have a cylindrical shape having a thickness in the rotation axis direction. A through hole $\mathbf{106}a_1$ is formed at a center of the main body portion 106*a* of the first opening/closing portion 106. The main body portion 106*a* of the first opening/closing portion 106 is freely rotatably supported by the separation wall portion 105 inserted through the through hole $\mathbf{106}a_1$.

The main body portion 106*a* of the first opening/closing portion 106 has first opening holes 106*b* (opening portions). The first opening holes 106*b* each pass through the main body portion 106*a* in the rotation axis direction. A plurality of first opening holes 106*b* are formed apart from each other in the circumferential direction. Here, description is made of a case in which the number of the first opening holes 106*b* is, for example, four. However, the number of first opening holes 106*b* may be one, two, three, or five or more. Further, when the number of the first opening holes 106*b* and the number of second opening holes 107*a* described later are each set to an odd number, an effect of resonance suppression is expected. In a plan-view shape of the first opening hole 106*b* (shape as viewed from the rotation axis direction or sectional shape perpendicular to the rotation axis direction), a length of the first opening hole 106*b* in the rotation direction on the inner side in the radial direction (radially inner side) is shorter than that on the outer side in the radial direction (radially outer side).

In the first opening hole 106*b*, an inner wall surface on the radially inner side and an inner wall surface on the radially outer side each have an arc shape. Curvature centers of the arcs are located at a center of the main body portion 106*a* (on the rotation axis or on the axial center of the shaft 7). In the first opening hole 106*b*, the inner wall surface on the radially inner side and the inner wall surface on the radially outer side are connected to each other by inner wall surfaces extending in the radial direction.

The second opening/closing portion 107 is an annular rib which is formed integrally with an inner wall surface on the radially outer side and an inner wall surface on the radially inner side (outer peripheral surface of the separation wall portion 105) at the parallel portion 102*a* of the auxiliary flow passage 102. The separation wall portion 105 is held by the second opening/closing portion 107 in the compressor housing 100. However, the separation wall portion 105 may be formed separately from the compressor housing 100 and mounted to the compressor housing 100.

The second opening/closing portion 107 is not limited to the annular shape, and, for example, a part thereof in the circumferential direction may be cut out. The second opening/closing portion 107 has a thickness in the rotation axis direction larger than that of the first opening/closing portion 106. However, the second opening/closing portion 107 may have a thickness equal to that of the first opening/closing portion 106, or may be thinner than the first opening/closing portion 106.

The second opening/closing portion 107 has second opening holes 107*a* (opening portions). The second opening holes 107*a* each pass through the second opening/closing portion 107 in the rotation axis direction. A plurality of (the same number as the first opening holes 106*b*) second opening holes 107*a* are formed apart from each other in the circumferential direction. A plan-view shape of each second opening hole 107*a* is substantially the same as that of the first opening hole 106*b*. However, as long as the auxiliary flow passage 102 can be opened and closed as described later, the plan-view shapes of the first opening/closing portion 106 and the second opening/closing portion 107 may be different from each other.

As illustrated in FIG. 3B and FIG. 3C, a projection portion 106*c* is formed on the outer peripheral surface of the first opening/closing portion 106. The cylindrical portion 100*a* of the compressor housing 100 has a through hole 100*b* passing therethrough in the radial direction. The through hole 100*b* extends longer in the circumferential direction than the first opening hole 106*b* and the second opening hole 107*a*. The projection portion 106*c* is located inside the through hole 100*b*. The projection portion 106*c* may be formed integrally with the first opening/closing portion 106. After the first opening/closing portion 106 is mounted to the compressor housing 100, the projection portion 106*c* may be mounted to the first opening/closing portion 106.

A drive unit 108 is provided on an outer peripheral surface of the cylindrical portion 100*a* on a through hole 100*b* side. The drive unit 108 includes an actuator formed of, for example, a motor and a solenoid. A distal end of the projection portion 106*c* is mounted to the drive unit 108. The drive unit 108 is configured to move the projection portion 106*c* in the rotation direction. That is, the drive unit 108 moves the first opening/closing portion 106 in the rotation direction. As long as the first opening/closing portion 106 can be moved in the rotation direction, any mechanism or structure may be adopted to the drive unit 108. The first opening/closing portion 106 slides in the rotation direction on the outer peripheral surface of the separation wall portion 105. The first opening/closing portion 106 moves between a closing position illustrated in FIG. 3B and an opening position illustrated in FIG. 3C.

Figure 4A:
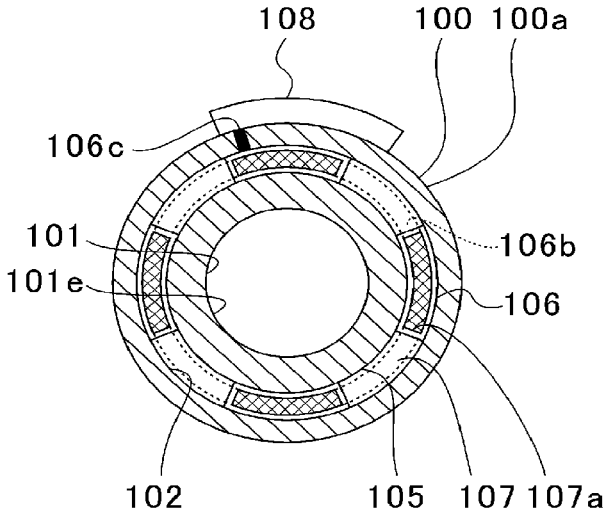
FIG. 4A is a sectional view taken at the same position as FIG. 3A (sectional view taken along the line IIIa-IIIa of FIG. 2).
Figure 4B:
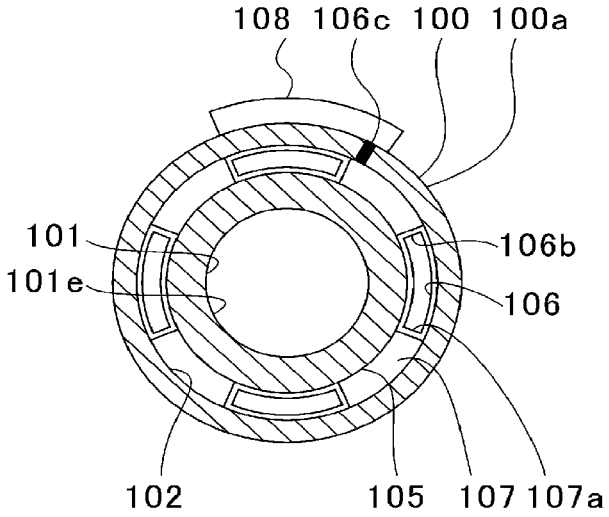
FIG. 4B is a sectional view taken at the same position as FIG. 3A (sectional view taken along the line IIIa-IIIa of FIG. 2).

FIG. 4A and FIG. 4B are each a sectional view taken at the same position as FIG. 3A (sectional view taken along the line IIIa-IIIa of FIG. 2). FIG. 4A is an illustration of a state in which the first opening/closing portion 106 takes the closing position. FIG. 4B is an illustration of a state in which the first opening/closing portion 106 takes the opening position. In FIG. 4A, the first opening/closing portion 106 which can be seen through the second opening holes 107*a* of the second opening/closing portion 107 is illustrated with cross hatching. In FIG. 4A, the first opening holes 106*b* of the first opening/closing portion 106 are indicated by broken lines. In FIG. 4A and FIG. 4B, the projection portion 106*c* of the first opening/closing portion 106 is illustrated with solid black.

As illustrated in FIG. 4A, when the first opening/closing portion 106 takes the closing position, the second opening holes 107*a* of the second opening/closing portion 107 are closed by the main body portion 106*a* of the first opening/closing portion 106; the first opening holes 106*b* of the first opening/closing portion 106 are closed by the second opening/closing portion 107. In such a manner, the auxiliary flow passage 102 is closed. As illustrated in FIG. 4B, when the first opening/closing portion 106 takes the opening position, the first opening holes 106*b* are aligned with (overlap) the second opening holes 107*a*. In such a manner, the auxiliary flow passage 102 is opened.

In a range with a small flow rate, the drive unit 108 moves the first opening/closing portion 106 to the closing position. The entire amount of air flows through the main flow passage 101. When the flow rate increases, the drive unit 108 moves the first opening/closing portion 106 to the opening position. The air flows through both the main flow passage 101 and the auxiliary flow passage 102. That is, the flow-passage sectional area increases. Through the increase in flow-passage sectional area, the reduction in operation range on the large flow rate side due to provision of the narrowing portion 101*e* can be suppressed. By that amount, a degree of reduction in flow-passage sectional area of the main flow passage 101 by the narrowing portion 101*e* can be increased, thereby increasing the operation range on the small flow rate side. The compression efficiency on the small flow rate side is improved. Through the use of the first opening/closing portion 106 and the second opening/closing portion 107, the opening/closing structure for the auxiliary flow passage 102 can be simplified.

Here, a length of the first opening hole 106*b* in the rotation direction may be substantially equal to a length of a wall portion in the rotation direction between adjacent first opening holes 106*b*. A length of the second opening hole 107*a* in the rotation direction may be substantially equal to a length of a wall portion in the rotation direction between adjacent second opening holes 107*a*. In this case, the auxiliary flow passage 102 can be completely closed, thereby securing a large flow passage sectional area given when the auxiliary flow passage 102 is opened. However, the length of the first opening hole 106*b* in the rotation direction may be longer than or shorter than the length of the wall portion in the rotation direction between adjacent first opening holes 106*b*. The length of the second opening hole 107*a* in the rotation direction may be longer than or shorter than the length of the wall portion in the rotation direction between adjacent second opening holes 107*a*.

Figure 5A:
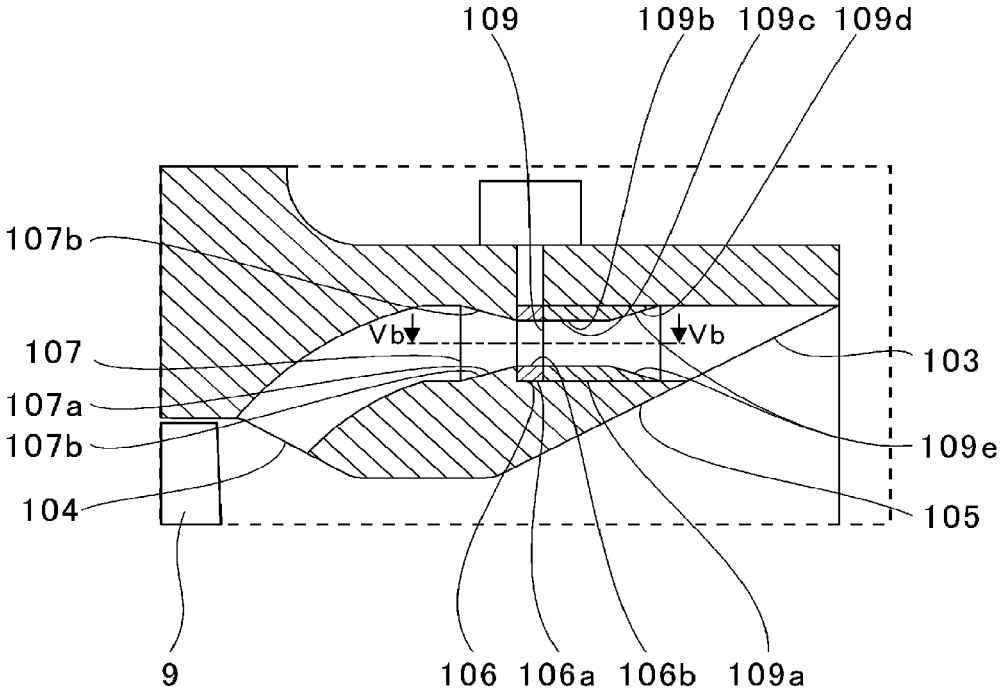
FIG. 5A is a sectional view taken at the same position as FIG. 2.
Figure 5B:
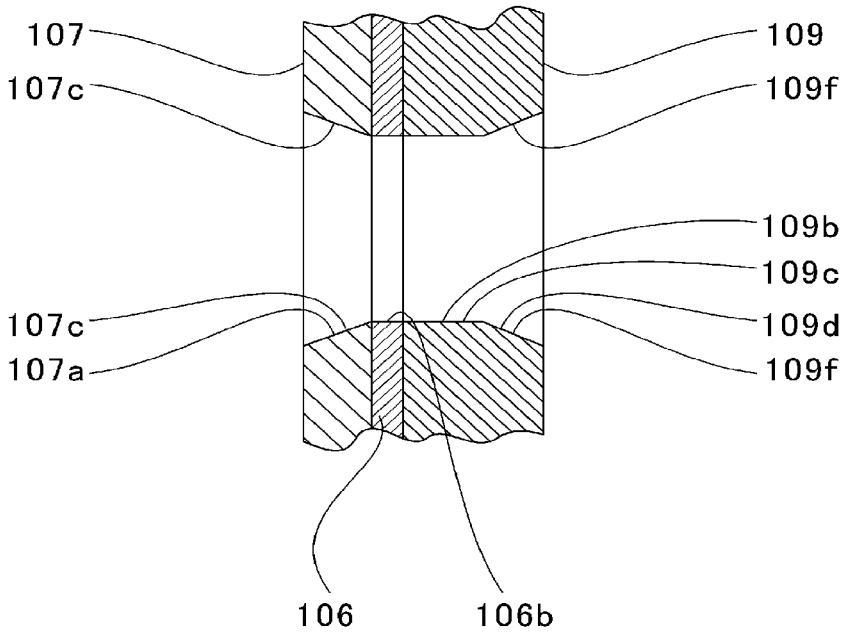
FIG. 5B is a sectional view taken along the line Vb-Vb of FIG. 5A.

FIG. 5A is a sectional view taken at the same position as FIG. 2. However, the first opening/closing portion 106 takes the closing position in FIG. 2, whereas the first opening/closing portion 106 takes the opening position in FIG. 5A. FIG. 5B is a sectional view taken along the line Vb-Vb of FIG. 5A. As illustrated in FIG. 5A and FIG. 5B, a fin 109 is mounted to the first opening/closing portion 106. A fin main body 109*a* of the fin 109 has an annular shape. The fin 109 is mounted to an end surface of the first opening/closing portion 106 on an upstream communication portion 103 side. Here, when the fin 109 is arranged, as described later, a flow of air is adjusted on upstream by an upstream guide portion 109*d* of the fin 109. Accordingly, air can easily flow into the first opening holes 106*b* of the first opening/closing portion 106.

A length of the fin 109 in the rotation axis direction is, for example, longer than that of the first opening/closing portion 106 and the second opening/closing portion 107. However, the length of the fin 109 in the rotation axis direction may be equal to that of one of the first opening/closing portion 106 and the second opening/closing portion 107, or may be shorter than that of the first opening/closing portion 106 or the second opening/closing portion 107.

A plan-view shape of the fin 109 is substantially the same as that of, for example, the first opening/closing portion 106. However, the plan-view shapes of the fin 109 and the first opening/closing portion 106 may be different from each other. The fin main body 109*a* has, at a center thereof, a through hole through which the separation wall portion 105 is inserted. The fin 109 rotates integrally with the first opening/closing portion 106. The fin 109 may be formed integrally with the first opening/closing portion 106.

The fin 109 has introduction holes 109*b*. The introduction holes 109*b* pass through the fin main body 109*a* in the rotation axis direction. A plurality of (the same number as the first opening holes 106*b*) introduction holes 109*b* are formed apart from each other in the circumferential direction. The introduction hole 109*b* is continuous with the first opening hole 106*b* toward the upstream communication portion 103 side (side away from the compressor impeller 9).

The introduction hole 109*b* includes a parallel portion 109*c* and an upstream guide portion 109*d*. An inner wall surface of the parallel portion 109*c* extends in the rotation axis direction. The parallel portion 109*c* is continuous with the first opening hole 106*b* toward the upstream communication portion 103 side (side away from the compressor impeller 9). The upstream guide portion 109*d* is continuous with the parallel portion 109*c* toward the upstream communication portion 103 side (side away from the compressor impeller 9).

As illustrated in FIG. 5A, a pair of guide surfaces 109*e* (first guide portions) are inner wall surfaces of the upstream guide portion 109*d* which are opposed to each other in the radial direction. The pair of guide surfaces 109*e* are inclined with respect to the rotation axis direction. The pair of guide surfaces 109*e* are reduced in separation distance therebetween in the radial direction as extending from the upstream communication portion 103 side toward a downstream communication portion 104 side. The guide surface 109*e* on the radially outer side extends toward the radially inner side as extending toward the compressor impeller 9. The guide surface 109*e* on the radially inner side extends toward the radially outer side as extending toward the compressor impeller 9.

As illustrated in FIG. 5B, a pair of guide surfaces 109*f* (first guide portions) are inner wall surfaces of the upstream guide portion 109*d* which are opposed to each other in the rotation direction. The pair of guide surfaces 109*f* are inclined with respect to the rotation axis direction. The pair of guide surfaces 109*f* are reduced in separation distance therebetween in the rotation direction as extending from the upstream communication portion 103 side toward the downstream communication portion 104 side.

The guide surfaces 109*e* and 109*f* of the upstream guide portion 109*d* allow air to easily flow into the parallel portion 109*c*. The parallel portion 109*c* adjusts a flow of air. The air is allowed to easily flow into the first opening hole 106*b* of the first opening/closing portion 106, thereby reducing pressure loss. However, any one of the parallel portion 109*c* and the upstream guide portion 109*d* may be omitted. Only one of the guide surfaces 109*e* and 109*f* may be provided to the upstream guide portion 109*d*.

As illustrated in FIG. 5A, the second opening hole 107*a* includes a pair of guide surfaces 107*b* (second guide portions). The pair of guide surfaces 107*b* are inner wall surfaces of the second opening hole 107*a* which are opposed to each other in the radial direction. The pair of guide surfaces 107*b* are inclined with respect to the rotation axis direction. The pair of guide surfaces 107*b* are increased in separation distance therebetween in the radial direction as extending from the upstream communication portion 103 side toward the downstream communication portion 104 side. The guide surface 107*b* on the radially outer side extends toward the radially outer side as extending toward the compressor impeller 9. The guide surface 107*b* on the radially inner side extends toward the radially inner side as extending toward the compressor impeller 9.

As illustrated in FIG. 5B, a pair of guide surfaces 107*c* (second guide portions) are inner wall surfaces of the second opening hole 107*a* which are opposed to each other in the rotation direction. The pair of guide surfaces 107*c* are inclined with respect to the rotation axis direction. The pair of guide surfaces 107*c* are increased in separation distance therebetween in the rotation direction as extending from the upstream communication portion 103 side toward the downstream communication portion 104 side.

The guide surfaces 107*b* and 107*c* of the second opening hole 107*a* allow air to easily flow out from the second opening hole 107*a*, thereby reducing pressure loss. However, the guide surfaces 107*b* and 107*c* are not essentially required, and the second opening hole 107*a* may extend in parallel with the rotation axis direction.

The fin 109 may be provided on the compressor impeller 9 side (downstream communication portion 104 side) with respect to the second opening/closing portion 107. In this case, the fin 109 is arranged in a state of being reversed in orientation in the rotation axis direction. The fin 109 may be omitted, and the guide surfaces 109*e* and 109*f* of the fin 109 may be provided to the first opening/closing portion 106.

Figure 6A:
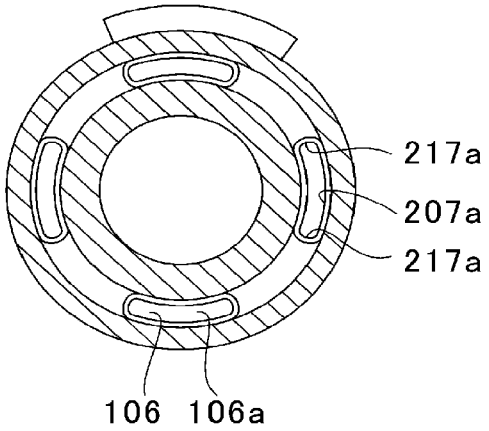
FIG. 6A is a sectional view taken at a position corresponding to FIG. 3A in a first modification example.
Figure 6B:
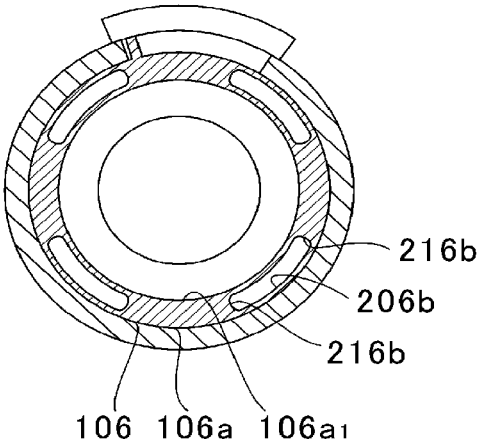
FIG. 6B is a sectional view taken at a position corresponding to FIG. 3B in the first modification example.
Figure 6C:
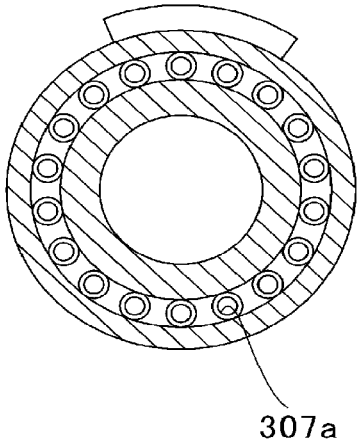
FIG. 6C is a sectional view taken at a position corresponding to FIG. 3A in a second modification example.
Figure 6D:
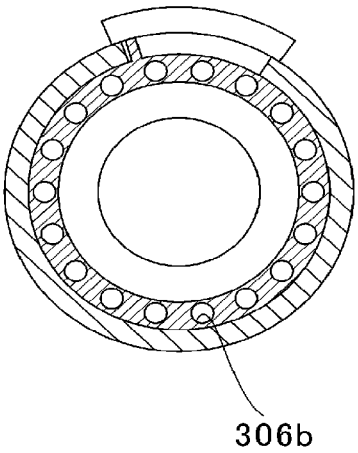
FIG. 6D is a sectional view taken at a position corresponding to FIG. 3B in the second modification example.

FIG. 6A is a sectional view taken at a position corresponding to FIG. 3A in a first modification example. FIG. 6B is a sectional view taken at a position corresponding to FIG. 3B in the first modification example. FIG. 6C is a sectional view taken at a position corresponding to FIG. 3A in a second modification example. FIG. 6D is a sectional view taken at a position corresponding to FIG. 3B in the second modification example.

As illustrated in FIG. 6A, in the first modification example, in a plan-view shape of each of second opening holes 207*a* (opening portions), both end portions 217*a* in the rotation direction each have a curved shape. Curvature centers of the both end portions 217*a* are located on an inner side of the second opening hole 207*a*. As illustrated in FIG. 6B, in a plan-view shape of each of first opening holes 206*b* (opening portions), both end portions 216*b* in the rotation direction each have a curved shape. Curvature centers of the both end portions 216*b* are located on an inner side of the first opening hole 206*b*. The first opening holes 206*b* and the second opening holes 207*a* each have, for example, an arc shape which is concentric with the through hole 106$a_1$ formed in the main body portion 106*a* of the first opening/closing portion 106. That is, the first opening holes 206*b* and the second opening holes 207*a* each have, for example, an arc shape with a curvature center located at a center of the main body portion 106*a* (on the rotation axis or on the axial center of the shaft 7).

As illustrated in FIG. 6C, in the second modification example, a plan-view shape of each of second opening holes 307*a* (opening portions) is circular. As illustrated in FIG. 6D, a plan-view shape of each of first opening holes 306*b* (opening portions) is circular.

The one embodiment of the present disclosure has been described above with reference to the attached drawings, but, needless to say, the present disclosure is not limited to the embodiment. It is apparent that those skilled in the art may arrive at various alternations and modifications within the scope of claims, and those examples are construed as naturally falling within the technical scope of the present disclosure.

For example, in the embodiment and modification examples described above, description is made of the case in which the first opening/closing portion 106 and the second opening/closing portion 107 are provided as a plurality of opening/closing portions. However, three or more opening/closing portions may be provided. When the opening portions of the opening/closing portions are arranged so as not to align when viewed from the rotation axis direction, the auxiliary flow passage 102 is substantially closed. When the opening portions of the opening/closing portions are arranged so as to align, the auxiliary flow passage 102 is opened.

Moreover, in the embodiment and modification examples described above, description is made of the case in which only the first opening/closing portion 106 operates. However, the second opening/closing portion 107 may be formed separately from the compressor housing 100 and operate.

Moreover, in the embodiment and modification examples described above, description is made of the case in which the first opening/closing portion 106 and the second opening/closing portion 107 are arranged on the upstream communication portion 103 side with respect to the impeller-side flow passage portion 102*b*. In this case, the pressure loss is reduced as compared to a case in which the first opening/closing portion 106 and the second opening/closing portion 107 are provided to the impeller-side flow passage portion 102*b*.

INDUSTRIAL APPLICABILITY

The present disclosure can be used for a centrifugal compressor having an auxiliary flow passage communicating to a main flow passage.

What is claimed is:

1. A centrifugal compressor, comprising:

an impeller;

a main flow passage which receives the impeller and extends in a rotation axis direction of the impeller;

an auxiliary flow passage which includes an upstream communication portion communicating to the main flow passage and a downstream communication portion communicating to the main flow passage at closer to the impeller than the upstream communication portion, and extends in a rotation direction of the impeller;

a first opening/closing portion arranged in the auxiliary flow passage, the first opening/closing portion including a first opening hole;

a drive unit configured to move the first opening/closing portion in the rotation direction;

a second opening/closing portion fixed to an inner wall of the auxiliary flow passage at a position closer to the downstream communication portion with respect to the first opening/closing portion, the second opening/closing portion including a second opening hole; and a fin positioned closer to the upstream communication portion with respect to the first opening/closing portion and integrally rotatable with the first opening/closing portion, the fin including an introduction hole having a pair of first guide surfaces continuous to the first opening hole on an upstream communication portion side, a distance between the pair of first guide surfaces decreasing as moving from the upstream communication portion side to a downstream communication portion side.

2. The centrifugal compressor according to claim 1, further comprising:

a narrowing portion provided in the main flow passage and projecting toward an inner side in a radial direction of the impeller with respect to the upstream communication portion and the downstream communication portion.

3. The centrifugal compressor according to claim 1, further comprising:

an impeller-side flow passage portion which is provided in the auxiliary flow passage, includes the downstream communication portion, and extends toward an inner side in a radial direction of the impeller as approaching the impeller, wherein the plurality of first and second opening/closing portions are arranged closer to the upstream communication portion than the impeller-side flow passage portion.

4. The centrifugal compressor according to claim 2, further comprising:

an impeller-side flow passage portion which is provided in the auxiliary flow passage, includes the downstream communication portion, and extends toward an inner side in a radial direction of the impeller as approaching the impeller, wherein the first and second opening/closing portions are arranged closer to the upstream communication portion than the impeller-side flow passage portion.

5. The centrifugal compressor according to claim 1, wherein the second opening/closing portion includes a pair of second guide portions whose separation distance increases as approaching the downstream communication portion away from the upstream communication portion.

6. The centrifugal compressor according to claim 2, wherein the second opening/closing portion includes a pair of second guide portions whose separation distance increases as approaching the downstream communication portion away from the upstream communication portion.

7. The centrifugal compressor according to claim 3, wherein the second opening/closing portion includes a pair of second guide portions whose separation distance increases as approaching the downstream communication portion away from the upstream communication portion.

8. The centrifugal compressor according to claim 1, wherein a plan-view shape of at least one of the first opening hole and the second opening hole at least has a length in the rotation direction on a radially inner side shorter than that on a radially outer side or has both end portions in the rotation direction in a curved shape.

9. The centrifugal compressor according to claim 2, wherein a plan-view shape of at least one of the first opening hole and the second opening hole at least has a length in the rotation direction on a radially inner side shorter than that on a radially outer side or has both end portions in the rotation direction in a curved shape.

10. The centrifugal compressor according to claim 3, wherein a plan-view shape of at least one of the first opening hole and the second opening hole at least has a length in the rotation direction on a radially inner side shorter than that on a radially outer side or has both end portions in the rotation direction in a curved shape.

11. The centrifugal compressor according to claim 4, wherein a plan-view shape of at least one of the first opening hole and the second opening hole at least has a length in the rotation direction on a radially inner side shorter than that on a radially outer side or has both end portions in the rotation direction in a curved shape.

12. The centrifugal compressor according to claim 5, wherein a plan-view shape of at least one of the first opening hole and the second opening hole at least has a length in the rotation direction on a radially inner side shorter than that on a radially outer side or has both end portions in the rotation direction in a curved shape.

* * * * *